US005515631A

United States Patent [19]

Nardy et al.

[11] Patent Number: 5,515,631

[45] Date of Patent: May 14, 1996

[54] BOOK SCROLL DEVICE

[76] Inventors: Gino J. Nardy, 2994 Pennview Ave., Broomall, Pa. 19008; Frank DiEgidio, 1047 Tremont Dr., Glenolden, Pa. 19036

[21] Appl. No.: 322,177

[22] Filed: Oct. 12, 1994

[51] Int. Cl.[6] ..... G09F 11/18

[52] U.S. Cl. ..... 40/518

[58] Field of Search ..... 40/471, 518, 519, 40/520, 521, 522, 523

[56] References Cited

U.S. PATENT DOCUMENTS

| | | | |
|---|---|---|---|
| 2,764,826 | 10/1956 | Fulton et al. | 40/518 |
| 3,293,782 | 12/1966 | Drexler | 40/471 |
| 3,364,604 | 1/1968 | Donaldson et al. | 40/471 |
| 3,513,577 | 5/1970 | Kleinman | 40/518 |
| 3,869,818 | 3/1975 | Marcellus | 40/471 |
| 4,180,933 | 1/1980 | Chammah | 40/471 |
| 4,209,824 | 6/1980 | Kaufman . | |
| 4,286,399 | 9/1981 | Funahashi et al. . | |
| 4,407,410 | 10/1983 | Graetz et al. . | |
| 4,854,879 | 8/1989 | Chang . | |
| 4,917,292 | 4/1990 | Drexler . | |
| 5,174,759 | 12/1992 | Preston et al. . | |

FOREIGN PATENT DOCUMENTS

| | | | |
|---|---|---|---|
| 686827 | of 1927 | Australia | 40/518 |

*Primary Examiner*—Brian K. Green
*Attorney, Agent, or Firm*—Michael I. Kroll

[57] ABSTRACT

A book scroll device is provided, which consists of a housing having a transparent main compartment, with a book scroll assembly. A structure is for carrying the book scroll assembly within the main compartment. A first facility is for unwinding the book scroll assembly within the main compartment, so that it can be viewed therefrom. a second facility is for rewinding the book scroll assembly within the main compartment, so that it can be removed therefrom.

4 Claims, 4 Drawing Sheets

BOOK SCROLL DEVICE

BACKGROUND OF THE INVENTION

1. Field of the Invention

The instant invention relates generally to books and more specifically it relates to a book scroll device.

2. Description of the Prior Art

Numerous books have been provided in prior art. For example U.S. Pat. Nos. 4,209,824 to Kaufman; 4,286,399 to Funahashi et al.; 4,407,410 to Graetz et al.; 4,854,879 to Chang; 4,917,292 to Drexler and 5,174,759 to Preston et al., all are illustrative of such prior art. While these units may be suitable for the particular purpose to which they address, they would not be as suitable for the purposes of the present invention as heretofore described.

KAUFMAN, BEVERLY F.

*ELECTRICALLY ILLUMINATED BOOK*

U.S. Pat. No. 4,209,824

The electrically illuminated book can include a single page such as a greeting card or multiple pages such as a child's picture or story book. A pictorial illustration is provided on the page in which an illustration portion could be expected realistically to emit light, and a miniature lamp which may be a light emitting diode is disposed within this illustration portion. An electrical assembly is carried by the book, the assembly including an electric power source connected operatively to the lamp, and a digitally operated switch for selectively energizing the lamp in the illustration portion. The page has adjacent superimposed sheets, one sheet providing the front side of the page and another sheet providing the reverse side of the page. A printed circuit card or electrical conductors such as wiring is disposed between the front and reverse sheets of the page and operatively connects the power source to the lamp. The electrical power source and digitally actuated switch are mounted on a cover attached to the page. A transparent film is attached to the page and overlies the lamp pro providing a protective shield. In one embodiment, the front and reverse sheets are each provided with the pictorial illustrations, and miniature lamps are disposed within the illustration portions on the front and reverse sheets of the page. The transparent film is attached to the page and overlies the lamps on the front and reverse sheets for providing the protective shield.

FUNAHASHI, MASAO

MAEDA, SHIGERU

*CARD OR BOOK INVOLVING LUMINESCENCE*

U.S. Pat. No. 4,286,399

At least one of two openable leaves is provided with at least one light-emitting diode, a thin battery for lighting the diode and a switch assembly. On opening the leaves, the diode emits light, which is extinguished when the leaves are closed to provide an indication of unique interest.

GRAETZ, HERBERT

UNTEIREINER, RONALD C.

*BOOK TYPE CASSETTE HOLDER AND METHOD OF MAKING SAME*

U.S. Pat. No. 4,407,410

A book simulating holder or album for cassettes and the like has a cover with front and rear flaps connected by a wide flexible spine with complementary interfitting trays on the inner faces of the flaps and, if desired, a pocket forming strip overlying the cover secured to the bottom and side edges thereof. The wide spine bows outwardly into an attractive closed book front end and tightens the pocket forming strip when the trays are in their stacked closed position. The trays are formed from a single sheet of plastics material and a portion of this sheet between the trays overlies the spine of the cover. Stiffeners such as cardboard are sandwiched between the bottoms of the trays and the flaps of the cover to rigidify the structure. The cover is also a single sheet of plastics material bonded around its marginal edges to the molded tray sheet and the pocket forming strip is simultaneously bonded to the cover. A projection on the bottom of the cassette receiving tray snugly receives the hub of a cassette tape reel. The pocket provided by the overlying strip on the cover may receive the rental or purchase strip for the cassette, while the portion of the pocket overlying the spine may receive a tab identifying the contents of the holder.

CHANG, DALE

*SELF-TEACHING BOOK FOR CHILDREN WITH AN ELECTRONIC DEVICE*

U.S. Pat. No. 4,854,879

A self-teaching book for children having a number of questions and a plurality of electronic teaching units on which a plurality of answers corresponding to each question are carried for the user to choose from. Each electronic teaching unit has seven superimposed layers, the arrangement of which is an answer sheet, an upper conducting layer, an upper insulating layer, a source layer, a lower insulating layer, a lower conducting layer and a protective covering. A plurality of slots are respectively arranged within the upper and lower insulating layers to permit the contact between the source layer and one of the upper and lower conducting layers to activate an electronic device.

DREXLER, JEROME

*BOOK ON A POCKET CARD*

U.S. Pat. No. 4,917,292

A plastic card or credit card size has a strip of optical recording material thereon containing microtext. The microtext is either electronically or optically reduced from 5 to 200 times and laid out in miniature pages, arranged in an array on the strip. The strip has a metallic or metal particle layer, giving it a shiny gold or silver coloration, against which the microtext appears dark, or vice-versa.

PRESTON, FRANK S.

BLAIR, PRESTON E.

*TV ANIMATION INTERACTIVELY CONTROLLED BY THE VIEWER THROUGH INPUT ABOVE A BOOK PAGE*

U.S. Pat. No. 5,174,759

A video system enables the operator to repeatedly touch a study object to change the action according to dramatics or game on a video display. An educational embodiment enables a student to touch the page of a printed book and effect multiple types of video response, selected on page by a student, educating the student of the meaning of the point in the printed text or graphics touched. A similar embodiment provides a solid object the student touches to effect multiple animations. Multiplexed workbooks and monitors enable the teacher's writing or drawing in workbook to be displayed on all, or selected, monitors. Questioning by the animation or in the workbook is answered by touching designated areas in the multiplexed workbooks to select an answer, which is timed, graded and recorded for the teacher's reference. The animation responds to the student's answers. Animation location coordinates coded in the tracks of recorded video images are compared to player and instrument position coordinates obtained by ultrasonic detection.

SUMMARY OF THE INVENTION

A primary object of the present invention is to provide a book scroll device that will overcome the shortcomings of the prior art devices.

Another object is to provide a book scroll device which contains a specially designed housing that will hold book scrolls for viewing, to encourage reading, learning and creativity for children.

An additional object is to provide a book scroll device, in which an artist unit which holds tracing paper can be attached to the case and be used to help learn math, spelling, etc., to play games, such as dot to dot, mazes, etc. and to trace and color pictures.

A further object is to provide a book scroll device that is simple and easy to use.

A still further object is to provide a book scroll device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
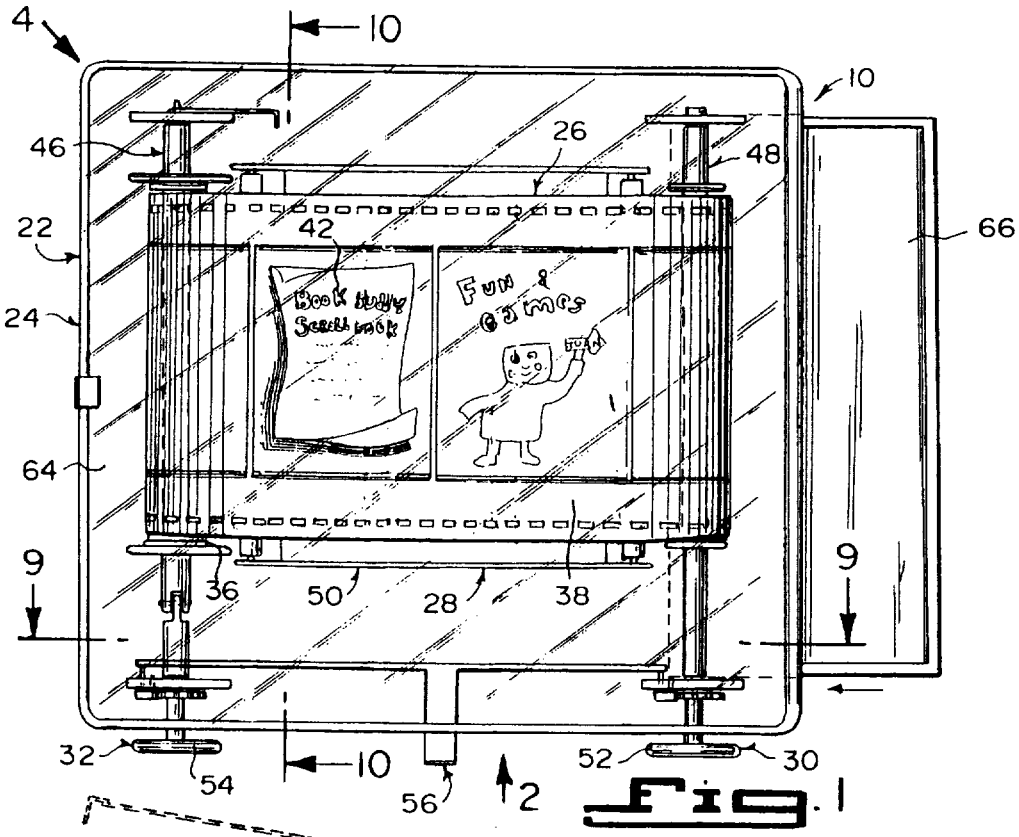
FIG. 1 is a top view of the instant invention.
Figure 2:
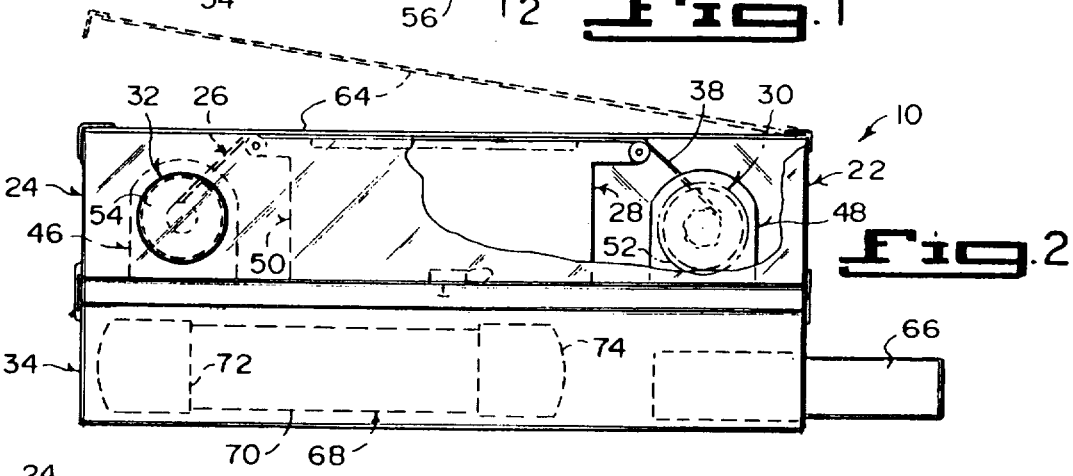
FIG. 2 is a front elevational view taken in the direction of arrow 2 in FIG. 1, with parts broken away.
Figure 3:
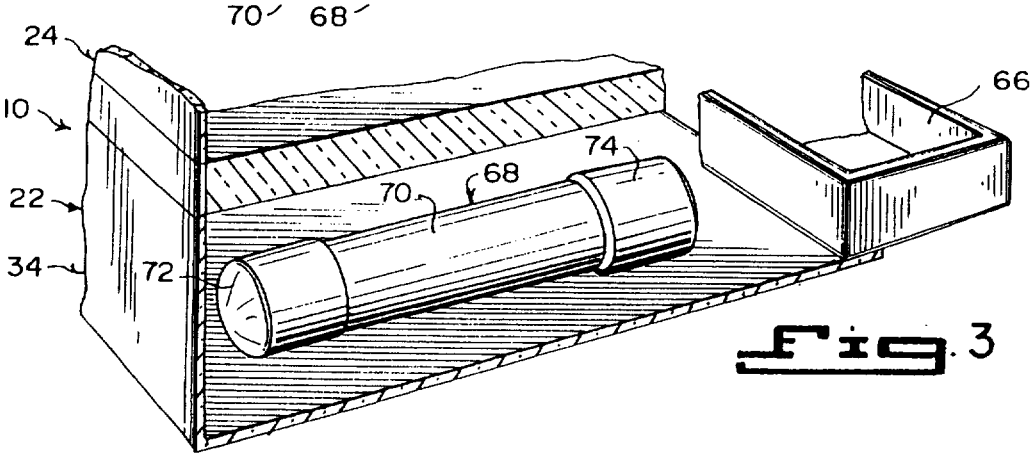
FIG. 3 is a perspective view with parts broken away and in section, showing the storage compartment in greater detail.

Turning now descriptively to the drawings, in which similar reference characters denote similar elements throughout the several views, FIGS. 1 through 4 illustrate a book scroll device 20, which consists of a housing 22 having a transparent main compartment 24 with a book scroll assembly 26. A structure 28 is for carrying the book scroll assembly 26 within the main compartment 24. A first facility 30 is for unwinding the book scroll assembly 26 within the main compartment 24, so that it can be viewed therefrom. A second facility 32 is for rewinding the book scroll assembly 26 within the main compartment 24, so that it can be removed therefrom.

The housing 22 also includes a storage compartment 34 under the main compartment 24, so that the book scroll assembly 26, when not in use, can be placed into the storage compartment 34.

Figure 5:
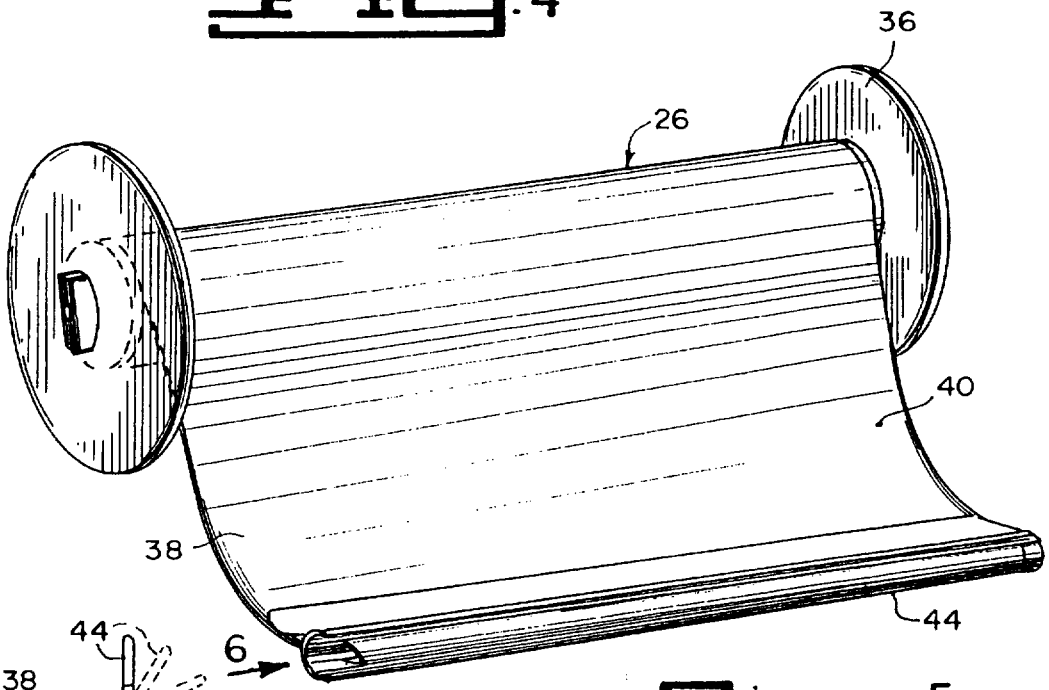
FIG. 5 is a perspective view of a book scroll of the feeding spool.
Figure 6:
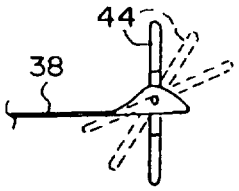
FIG. 6 is a side view taken in the direction of arrow 6 in FIG. 5, showing the flexible locking tab in greater detail.
Figure 7:
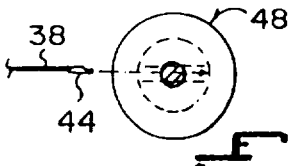
FIG. 7 is a side view showing the flexible locking tab being inserted into a slot in a scroll receiving spool.

As best seen in FIGS. 5, 6 and 7, the book scroll assembly 26 contains a spool 36. A book scroll 38 is fabricated out of lightweight plastic 40 and has indicia 42 printed thereon, which is wrapped about the spool 36. A flexible locking tab 44 is on a free end of the book scroll 38.

The carrying structure 28 includes a scroll feeding unit 46, rotatively mounted within one side of the main compartment 24, to retain the spool 36 thereon. A scroll receiving unit 48 is rotatively mounted within an opposite side of the main compartment 24, to take the flexible locking tab 44 therein. A roller unit 50 is mounted within the main compartment 24 between the scroll feeding unit 46 and the scroll receiving unit 48, so as to support a portion of the book scroll 38 extending thereacross.

The unwinding facility 30 is a first turning knob 52 affixed to a portion of the scroll receiving unit 48, extending through the main compartment 24. When the first turning knob 52 is rotated clockwise, the book scroll 38 will unwind from the spool 36.

The rewinding facility 32 is a second turning knob 54 affixed to a portion of the scroll feeding unit 46 extending through the main compartment 24. When the second turning knob 54 is rotated counterclockwise, the book scroll 38 will rewind back onto the spool 36.

Figure 8:
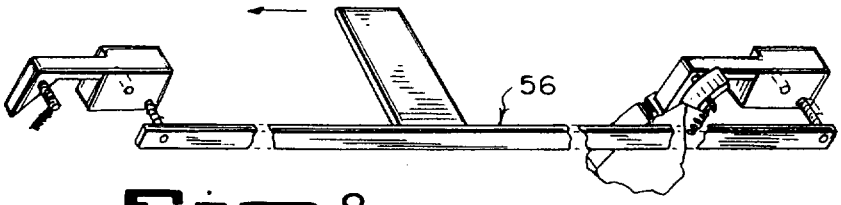
FIG. 8 is a rear perspective view with parts broken away of the stopper release assembly.
Figure 9:
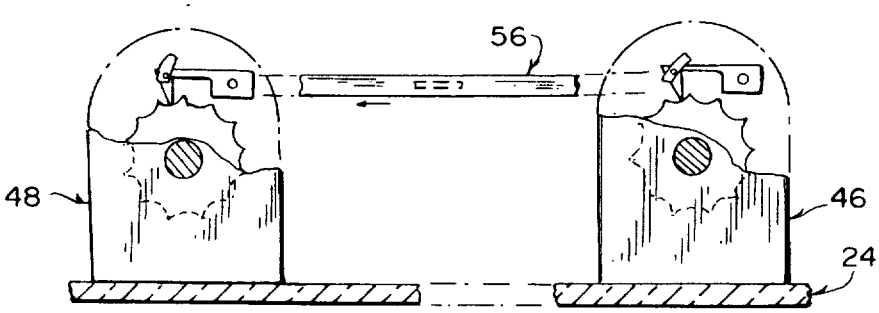
FIG. 9 is a cross sectional view taken along line 9—9 in FIG. 1, with parts broken away removed and in phantom.
Figure 10:
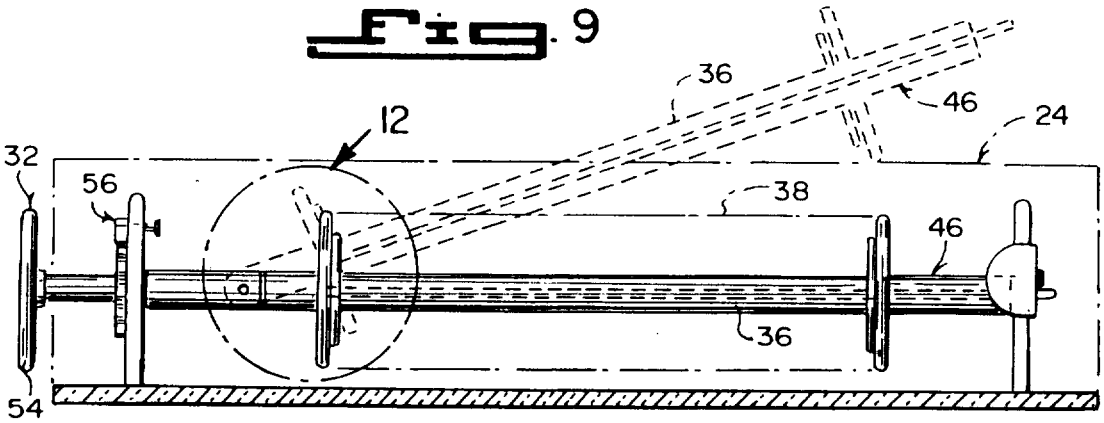
FIG. 10 is a cross sectional view taken along line 10—10 in FIG. 1, with parts removed and shown in phantom.
Figure 11:
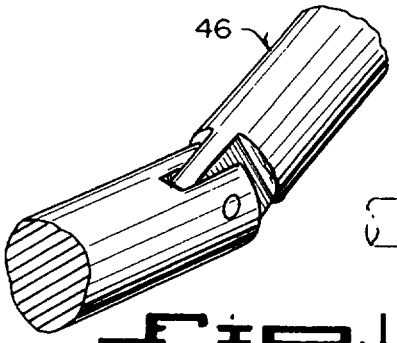
FIG. 11 is a perspective view of a portion of the shaft of the scroll feeding unit, showing the pivot structure in greater detail.
Figure 12:
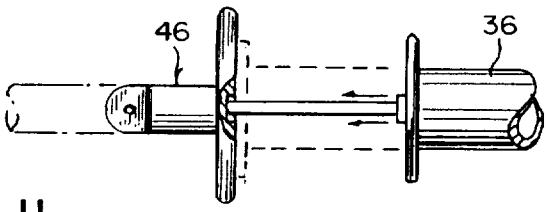
FIG. 12 is a detailed view of a portion of the scroll feeding unit as indicated by arrow 12 in FIG. 10, showing the assembly of the scroll feeding spool.
Figure 13:
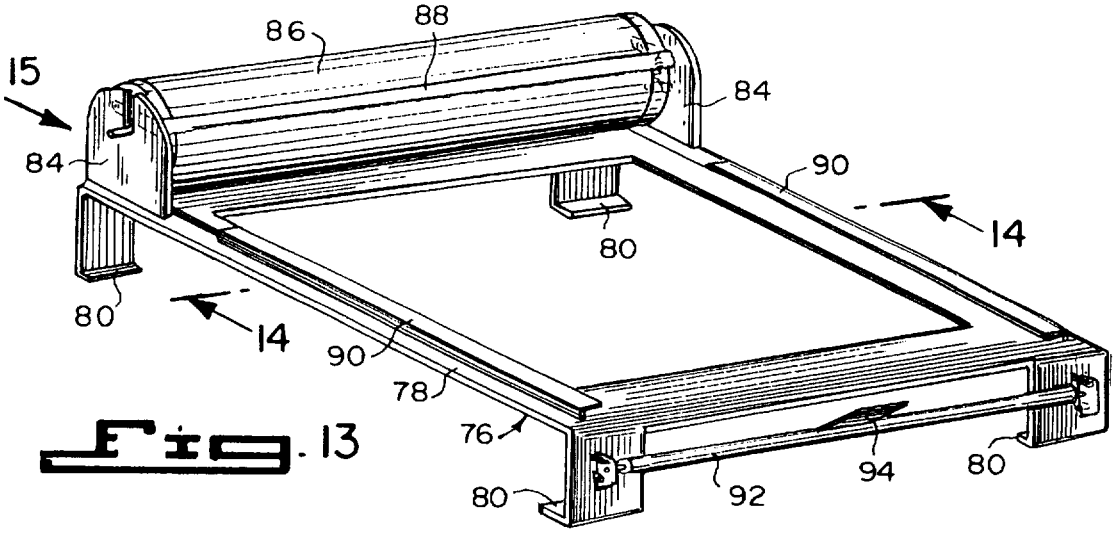
FIG. 13 is a perspective view of the artist unit.
Figure 14:
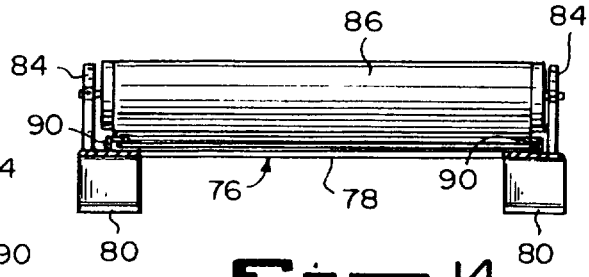
FIG. 14 is a cross sectional view taken along line 14—14 in FIG. 13.
Figure 15:
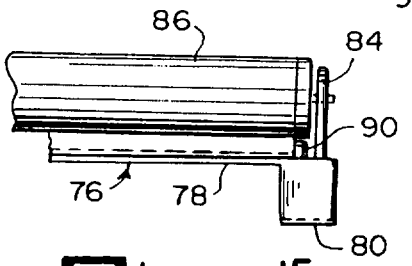
FIG. 15 is a rear view of a portion thereof taken in the direction of arrow 15 in FIG. 13.
Figure 16:
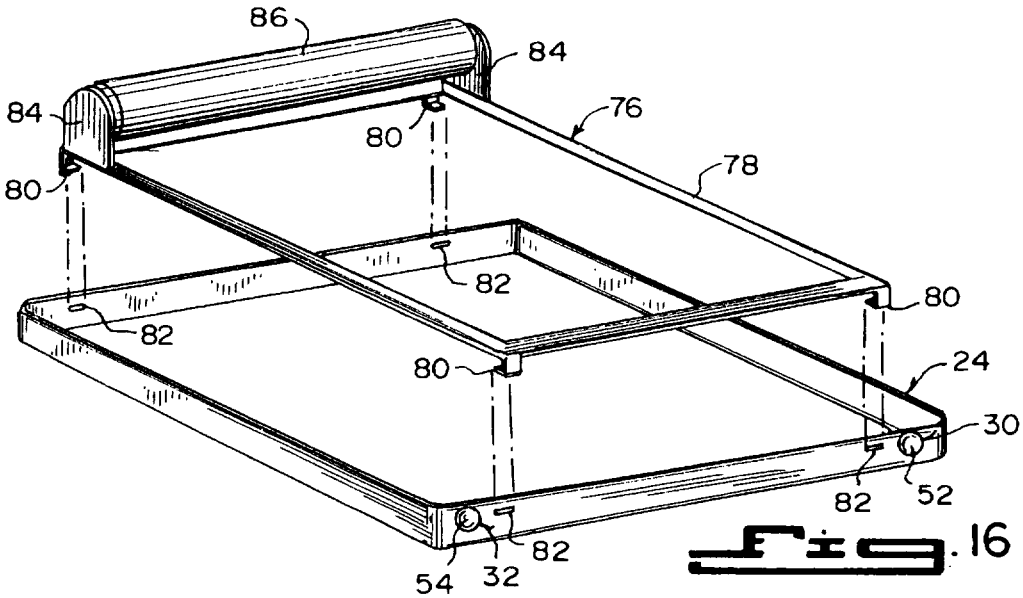
FIG. 16 is an exploded perspective view, showing how the artist unit will be attached to the main compartment.

A stopper release mechanism 56, best shown in FIG. 8 and 9, normally engages with the scroll feeding unit 46 and the scroll receiving unit 48, to inhibit the book scroll 38 from freely unwinding. The stopper release mechanism 56 can be manually disengaged, to allow the book scroll 38 to unwind.

Figure 4:
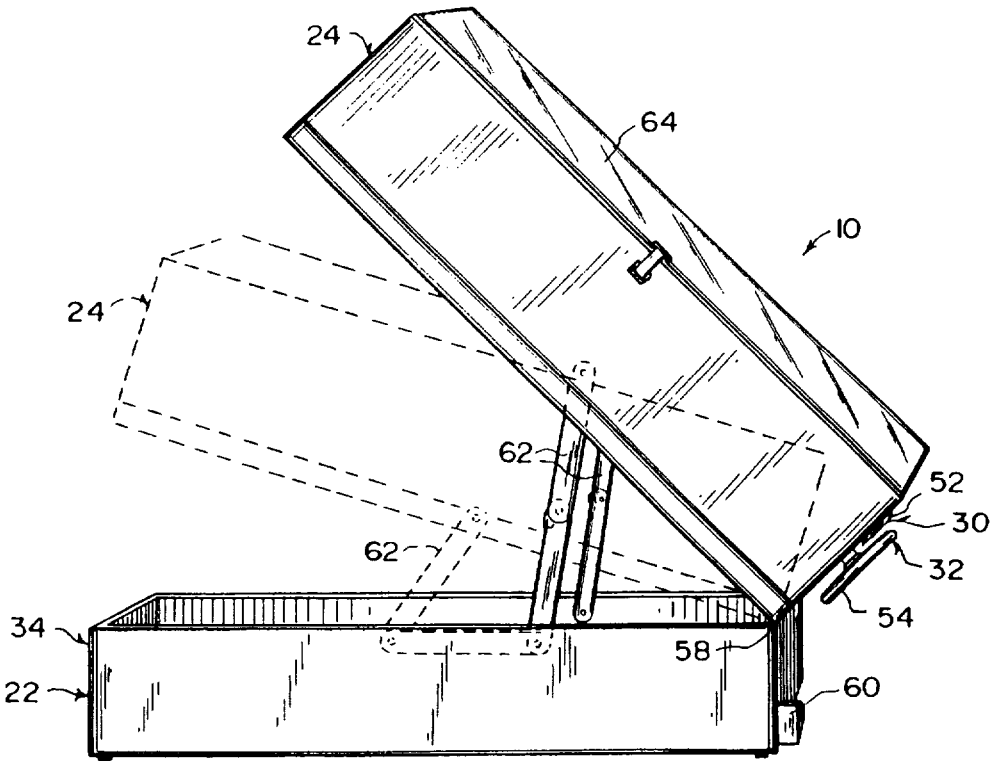
FIG. 4 is a side perspective view taken in the direction of arrow 4 in FIG. 1, showing the main compartment raised and locked with respect to the storage compartment.

FIG. 4 shows a hinge 58 between one side of the main compartment 24 and the storage compartment 34. A stabilizing foot 60 is mounted to the storage compartment 34 under the hinge 58. A pair of drop rail locks 62 are affixed between a front wall and rear wall of the main compartment 24 and the storage compartment 34. The main compartment 24 can be maintained in an angular position, to allow a person to better view the book scroll 38 within the main compartment 24.

The main compartment 24 includes a top lid 64 hinged thereto, so as to gain access therein, to remove and replace the book scroll assembly 26 when needed. The storage compartment 34 contains a pull out drawer 66, for holding small articles therein, such as writing instruments and the like. A storage case 68 is also provided, having an elongated tube 70 with a stationary cap 72 at a first end and a removable cap 74 at a second end, for holding the book scroll assembly 26 therein when not in use.

An artist unit 76, shown in FIG. 13 to 16, can be removably attached to the main compartment 24. The artist unit 76 consists of a frame 78 with a plurality of locking tabs 80, which fit into slots 82 formed in the main compartment 24. A holder 84 is on a back end of the frame 78, for rotatively maintaining a roll of tracing paper 86 thereon. A cutting blade 88 can be coupled to the holder 84. A pair of side guide members 90 can be on the frame 78, to prevent excess lateral movement of the tracing paper 86. A spring biased clamping bar 92 with a release lever 94 can be on a front end of the frame 78, for releasably holding a forward edge of the tracing paper 86 to the frame 78.

LIST OF REFERENCE NUMBERS

20 book scroll device
22 housing
24 transparent main compartment of 22
26 book scroll assembly
28 carrying structure
30 unwinding facility
32 rewinding facility
34 storage compartment of 22
36 spool
38 book scroll
40 lightweight plastic
42 indicia on 38
44 flexible locking tab on 38
46 scroll feeding unit
48 scroll receiving unit
50 roller unit
52 first turning knob for 30
54 second turning knob for 32
56 stopper release mechanism
58 hinge between 24 and 34
60 stabilizing foot on 34
62 drop rail lock between 24 and 34
64 top lid on 24
66 pull out drawer in 34
68 storage case
70 elongated tube of 68
72 stationary cap of 68
74 removable cap of 68
76 artist unit
78 frame of 76
80 locking tab on 78
82 slot in 24
84 holder on 78
86 roll of tracing paper in 84
88 cutting blade on 84
90 side guide member on 78
92 spring biased clamping bar on 78
94 release lever of 92

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A book scroll device which comprises:

a) a housing having a transparent main compartment, said housing including a storage compartment under said main compartment, b) a book scroll assembly, said book scroll assembly including a spool, a book scroll being fabricated out of lightweight plastic, having indicia printed thereon which is wrapped about said spool, and a flexible locking tab on a free end of said book scroll;

c) means for carrying said book scroll assembly within said main compartment, said carrying means including a scroll feeding unit rotatively mounted within one side of said main compartment to retain said spool thereon, a scroll receiving unit rotatively mounted within an opposite side of said main compartment to take said flexible locking tab therein, and a roller unit mounted within said main compartment, between said scroll feeding unit and said scroll receiving unit, so as to support a portion of said book scroll extending thereacross;

d) means for unwinding said book scroll assembly within said main compartment, so that it can be viewed therefrom, said unwinding means is a first turning knob affixed to a portion of said scroll receiving unit extending through said main compartment, so that when said first turning knob is rotated clockwise, said book scroll will unwind from said spool; and e) means for rewinding said book scroll assembly within said main compartment, so that it can be removed therefrom, said rewinding means is a second turning knob affixed to a portion of said scroll feeding unit extending through said main compartment, so that when said second turning knob is rotated counterclockwise, said book scroll will rewind back onto said spool;

f) a stopper release mechanism, which normally engages with said scroll feeding unit and said scroll receiving unit to inhibit said book scroll from freely unwinding, whereby said stopper release mechanism can be manually disengaged to allow said book scroll to unwind;

g) a hinge, a first end of said hinge being attached to said main compartment and a second end being attached to said storage compartment;

h) a stabilizing foot mounted to said storage compartment under said hinge; and i) a pair of drop rail locks affixed between a front wall and rear wall of said main compartment and said storage compartment, so that said main compartment can be maintained in an angular position to allow a person to better view said book scroll within said main compartment.

2. A book scroll device as recited in claim 1, wherein said main compartment includes a top lid hinged thereto, so as to gain access therein to remove and replace said book scroll assembly when needed.

3. A book scroll device as recited in claim 2, wherein said storage compartment includes:

a) a pull out drawer for holding small articles therein, such as writing instruments; and b) a storage case having an elongate tube, with a stationary cap at a first end and a removable cap at a second end, for holding said book scroll assembly therein when not in use.

4. A book scroll device as recited in claim 3, further including an artist unit, which can be removably attached to said main compartment and having a frame with a plurality of locking tabs which fit into slots formed in said main compartment, a holder on a back end of said frame for rotatively maintaining a roll of tracing paper thereon, a cutting blade coupled to said holder, a pair of side guide members on said frame, to prevent excess lateral movement of the tracing paper and a spring biased clamping bar with a release lever on a front end of said frame, for releasably holding a forward edge of the tracing paper to said frame.

* * * * *